US009032707B1

(12) United States Patent
Piazza, Sr.

(10) Patent No.: US 9,032,707 B1
(45) Date of Patent: May 19, 2015

(54) DIESEL EXHAUST GAS COLLECTION AND TREATMENT SYSTEM

(71) Applicant: Rosolino J. Piazza, Sr., Longmont, CO (US)

(72) Inventor: Rosolino J. Piazza, Sr., Longmont, CO (US)

( * ) Notice: Subject to any disclaimer, the term of this patent is extended or adjusted under 35 U.S.C. 154(b) by 64 days.

(21) Appl. No.: 14/037,094

(22) Filed: Sep. 25, 2013

Related U.S. Application Data

(63) Continuation-in-part of application No. 12/841,930, filed on Jul. 22, 2010, now abandoned.

(51) Int. Cl.
*F01N 3/00* (2006.01)

(52) U.S. Cl.
CPC ..... *F01N 3/00* (2013.01)

(58) Field of Classification Search
USPC ..... 60/272–324
See application file for complete search history.

(56) References Cited

U.S. PATENT DOCUMENTS

| | | | | |
|---|---|---|---|---|
| 1,867,325 | A | 7/1932 | Neville | |
| 2,737,260 | A | 3/1956 | Jenison | |
| 3,086,353 | A * | 4/1963 | Ridgway | 60/285 |
| 3,224,171 | A | 12/1965 | Bowman | |
| 3,817,032 | A * | 6/1974 | Crow | 60/294 |
| 3,872,666 | A * | 3/1975 | Bentley | 60/277 |
| 4,149,377 | A * | 4/1979 | Takagi et al. | 60/278 |
| 4,209,981 | A | 7/1980 | Miyamori et al. | |
| 4,240,253 | A | 12/1980 | Nakamura et al. | |
| 4,325,346 | A | 4/1982 | Yokoyama | |
| 4,628,689 | A | 12/1986 | Jourdan | |
| 4,640,256 | A | 2/1987 | Conrad et al. | |
| 4,864,825 | A * | 9/1989 | Kakuta | 60/598 |
| 4,873,823 | A * | 10/1989 | Curths | 60/293 |
| 5,524,434 | A | 6/1996 | Ma | |
| D376,602 | S | 12/1996 | Yamanaka et al. | |
| 5,609,021 | A | 3/1997 | Ma | |
| 5,685,145 | A | 11/1997 | Sung et al. | |
| 6,044,643 | A | 4/2000 | Ittner et al. | |
| 7,296,400 | B2 | 11/2007 | Nakada | |
| 2005/0284691 | A1 * | 12/2005 | Voss et al. | 181/255 |
| 2007/0240404 | A1 * | 10/2007 | Pekrul et al. | 60/282 |
| 2011/0072802 | A1 | 3/2011 | Bidner et al. | |

* cited by examiner

*Primary Examiner* — Jesse Bogue

(57) ABSTRACT

A diesel exhaust gas collection and treatment system for collecting exhaust gas from a diesel engine powered vehicle, treating the exhaust gas with injected ambient air, then releasing the air and exhaust gas mixture to the atmosphere features a vehicle powered by a diesel engine. A stream of exhaust gas from operation of the diesel engine flows through an exhaust manifold into a generally tubular exhaust collector via an exhaust inlet port. A plurality of ambient air injection ports is located on a posterior collector end, each having an ambient air injection tube connected to a corresponding air injection port. The exhaust collector features a plurality of collector outlet ports located on the exhaust collector side wall, each having a collector outlet pipe located on and fluidly connected to a corresponding collector outlet port. The exhaust collector is flexibly suspended underneath a vehicle.

9 Claims, 4 Drawing Sheets

(Side View)

(Side View)

(Top View)

(Rear View)

(In-Use View)

(Front View)

DIESEL EXHAUST GAS COLLECTION AND TREATMENT SYSTEM

CROSS REFERENCE

This application is a continuation-in-part of U.S. patent application Ser. No. 12/841,930 filed Jul. 22, 2010, the specification(s) of which is/are incorporated herein in their entirety by reference.

FIELD OF THE INVENTION

The present invention relates to systems pertaining to improvement of power and reduction of emissions in diesel engine applications.

BACKGROUND OF THE INVENTION

Diesel engines are internal combustion engines that use a glow plug to ignite a compressed fuel/air mixture injected into the combustion chamber in contrast to gasoline engines, which are also internal combustion engines, but use a spark plug to ignite a compressed fuel/air mixture at a much lower compression ratio. Exhaust gas from a diesel engine is typically very dark and easily distinguishable from exhaust gas from a gasoline engine. The present invention features a diesel exhaust gas collection and treatment system for collecting exhaust gas from a diesel engine powered vehicle, treating the exhaust gas with injected ambient air, then releasing the air and exhaust gas mixture to the atmosphere.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a diesel exhaust gas collection and treatment system for collecting exhaust gas from a diesel engine powered vehicle, treating the exhaust gas with injected ambient air, then releasing the air and exhaust gas mixture to the atmosphere. In some embodiments, the system comprises a vehicle powered by a diesel engine. In some embodiments, the diesel engine comprises an exhaust manifold located thereon. In some embodiments, a stream of exhaust gas from operation of the diesel engine flows from the diesel engine through the exhaust manifold.

In some embodiments, the system comprises a generally tubular exhaust collector. In some embodiments, an anterior chamber is located inside next to the anterior collector end and a posterior chamber is located inside next to the posterior chamber. In some embodiments, the anterior chamber is separated from the posterior chamber via a non-solid planar divider.

In some embodiments, the exhaust collector comprises an exhaust inlet port centrally located on the anterior collector end. In some embodiments, the exhaust inlet port is fluidly connected to the exhaust manifold via exhaust piping. In some embodiments, the exhaust collector comprises a plurality of ambient air injection ports located on the posterior collector end. In some embodiments, the exhaust collector comprises a plurality of ambient air injection tubes. In some embodiments, each air injection tube is fluidly located on and connected to a corresponding air injection port. In some embodiments, an air injection tube inlet and an air injection tube outlet face a same direction. In some embodiments, the injection tube comprises a tube inlet diameter at least two times larger than a tube outlet diameter for acceleration of the ambient air passing through the air injection tube.

In some embodiments, the exhaust collector comprises a plurality of collector outlet ports located on the exhaust collector side wall thereon. In some embodiments, the exhaust collector comprises a plurality of collector outlet pipes. In some embodiments, each collector outlet pipe is located on and fluidly connected to a corresponding collector outlet port. In some embodiments, each collector outlet pipe comprises an open outlet pipe terminating end facing a direction opposed the injection tube inlet.

In some embodiments, the exhaust collector is flexibly suspended underneath a vehicle. In some embodiments, the exhaust inlet port is located opposite the air injection ports to optimize mixing of the stream of exhaust gas and the accelerated stream of ambient air from the ambient air injection ports. In some embodiments, the collector outlet ports are located at a right angle to the exhaust inlet port and the air injection ports.

DESCRIPTION OF PREFERRED EMBODIMENTS

Figure 1:
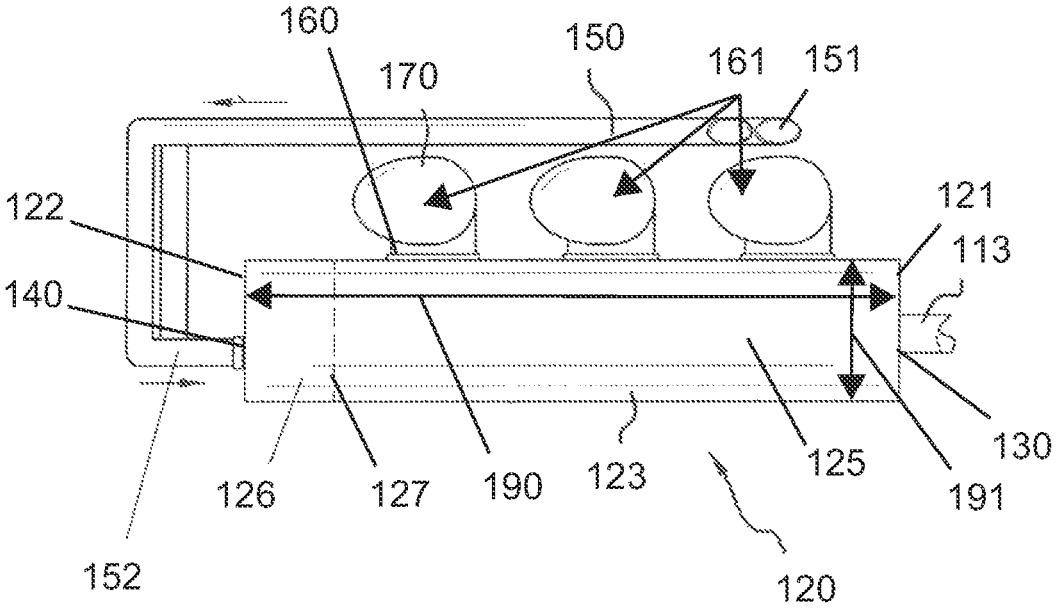
FIG. 1 shows a side view of the exhaust collector of the present invention.

Following is a list of elements corresponding to a particular element referred to herein:

100 Diesel exhaust gas collection and treatment system
110 Vehicle
111 Diesel engine
112 Exhaust manifold
113 Exhaust piping
115 First vehicle side
116 Second vehicle side
120 Exhaust collector
121 Anterior collector end
122 Posterior collector end
123 Collector side wall
125 Anterior chamber
126 Posterior chamber
127 Divider
130 Exhaust inlet port
131 Exhaust inlet port cross-sectional area
140 Air injection port
150 Air injection tube
151 Injection tube inlet
152 Injection tube outlet
153 Tube inlet diameter
154 Tube outlet diameter
160 Collector outlet port
161 Collector outlet port crass-sectional area
170 Collector outlet pipe
171 Outlet pipe terminating end

180 Hood
190 Collector length
191 Collector width

Figure 2:
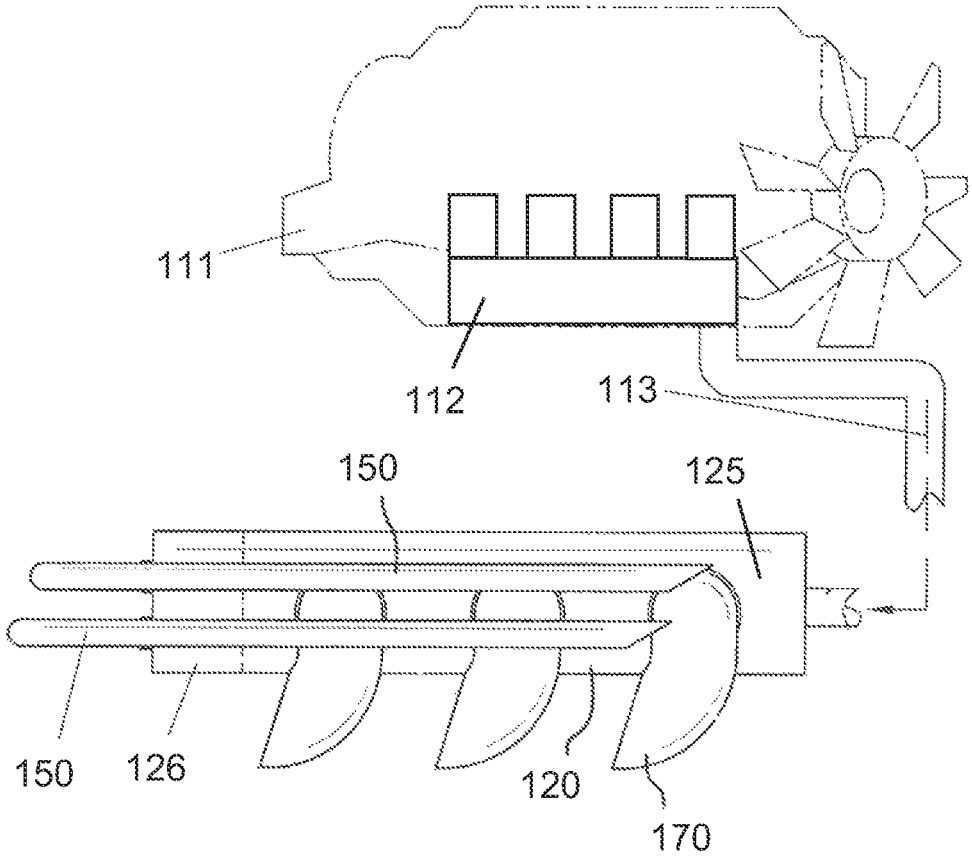
FIG. 2 shows a top view of the present invention.
Figure 3:
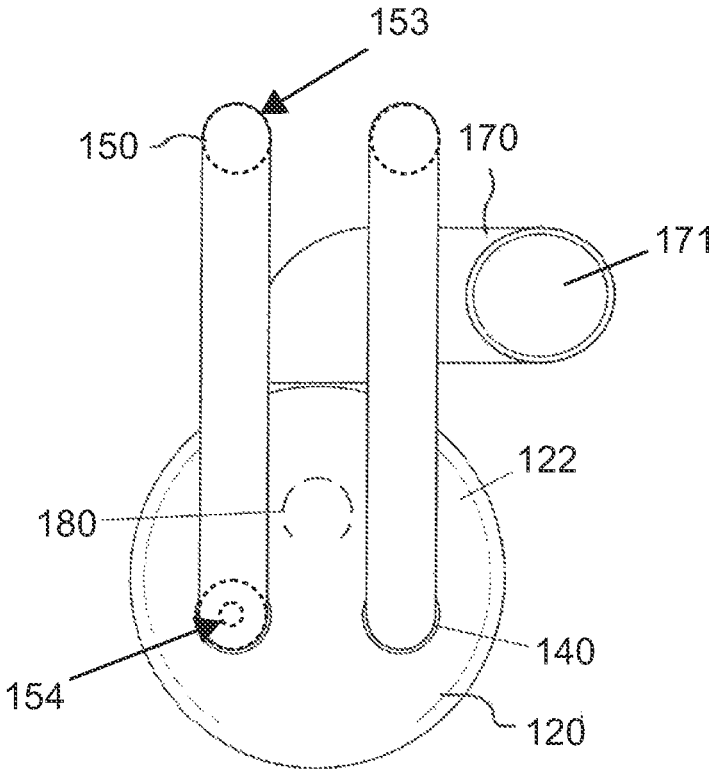
FIG. 3 shows a rear view of the exhaust collector of the present invention.
Figure 4:
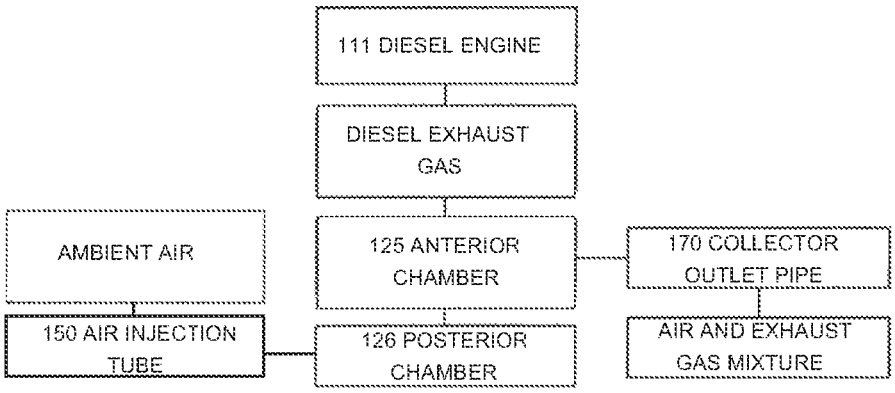
FIG. 4 shows a schematic of the present invention.
Figure 5:
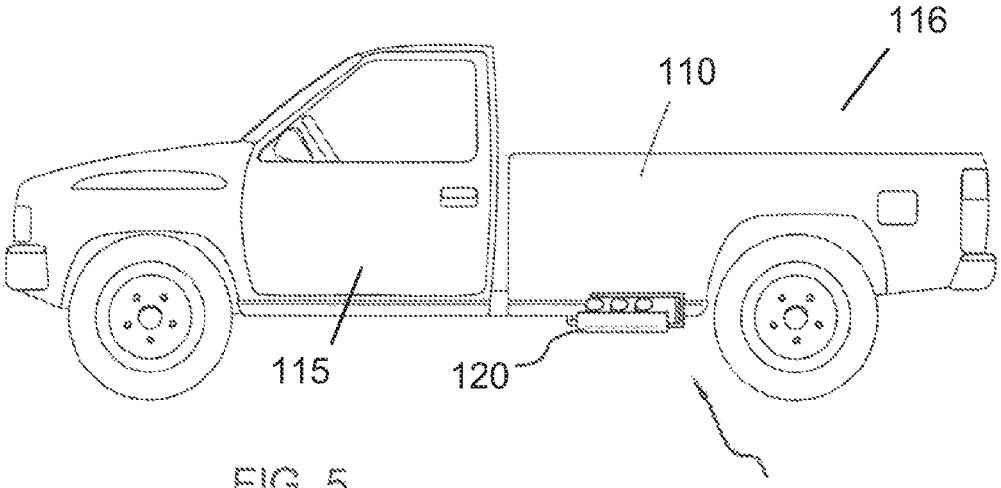
FIG. 5 shows a side view of the present invention.
Figure 6:
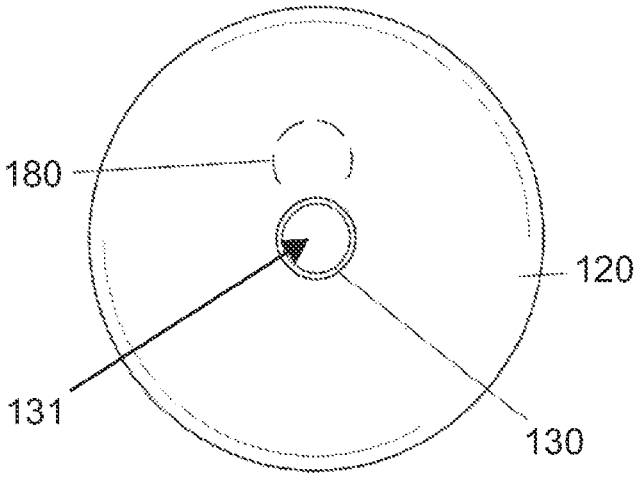
FIG. 6 shows a front view of the exhaust collector of the present invention.

Referring now to FIG. 1-6, the present invention features a diesel exhaust gas collection and treatment system (100) for collecting exhaust gas from a diesel engine powered vehicle, treating the exhaust gas with injected ambient air, then releasing the air and exhaust gas mixture to the atmosphere. In some embodiments, the system (100) comprises a vehicle (110) powered by a diesel engine (111). In some embodiments, the diesel engine (111) comprises an exhaust manifold (112) located thereon. In some embodiments, the diesel engine (111) comprises two exhaust manifolds (112) located thereon. In some embodiments, a stream of exhaust gas from operation of the diesel engine (111) flows from the diesel engine (111) through the exhaust manifold (112). Diesel engines (111), exhaust manifolds (112), and the operation of diesel engines (111) including characteristics of the exhaust gas are well known to those of ordinary skill in the art.

In some embodiments, the system (100) comprises a generally tubular exhaust collector (120) having an anterior collector end (121), a posterior collector end (122), and a collector side wall (123). In some embodiments, an anterior chamber (125) is located therein next to the anterior collector end (121) and a posterior chamber (126) is located therein next to the posterior chamber (126). In some embodiments, the anterior chamber (125) is separated from the posterior chamber (126) via a non-solid planar divider (127).

In some embodiments, the exhaust collector (120) comprises an exhaust inlet port (130) centrally located on the anterior collector end (121). In some embodiments, the exhaust inlet port (130) is fluidly connected to the anterior chamber (125). In some embodiments, the exhaust net port (130) is fluidly connected to the exhaust manifold (112) via exhaust piping (113). In some embodiments, the exhaust net port (130) is flexibly connected to the exhaust piping (113).

In some embodiments, the exhaust collector (120) comprises a plurality of ambient air injection ports (140) located on the posterior collector end (122). In some embodiments, each air injection port (140) is fluidly connected to the posterior chamber (126).

In some embodiments, the exhaust collector (120) comprises a plurality of ambient air injection tubes (150). In some embodiments, each air injection tube (150) is fluidly located on and connected to a corresponding air injection port (140). In some embodiments, each air injection tube (150) comprises an injection tube net (151) and an injection tube outlet (152). In some embodiments, the air injection tube inlet (151) and the air injection tube outlet (152) face a same direction. In some embodiments, the injection tube comprises a tube inlet diameter (153) at least two times larger than a tube outlet diameter (154) for acceleration of the ambient air passing through the air injection tube (150). In some embodiments, the speed of the stream of ambient air is accelerated by the reduction in diameter of the tubing. In some embodiments, the air injection port (140) is flexibly connected to the air injection tube (150).

In some embodiments, the exhaust collector (120) comprises a plurality of collector outlet ports (160) located on the exhaust collector side wall (123). In some embodiments, each collector outlet port (160) is fluidly connected to the anterior chamber (125).

In some embodiments, the exhaust collector (120) comprises a plurality of collector outlet pipes (170). In some embodiments, each collector outlet pipe (170) is located on and fluidly connected to a corresponding collector outlet port (160). In some embodiments, each collector outlet pipe (170) comprises an open outlet pipe terminating end (171) facing a direction opposed the injection tube inlet (151). In some embodiments, the collector outlet port (160) is flexibly connected to the collector outlet pipe (170).

In some embodiments, the exhaust collector (120) is flexibly suspended underneath the vehicle (110). In some embodiments, the exhaust collector (120) is located next to a first vehicle side (115) or a second vehicle side (116). In some embodiments, it is critical for the exhaust collector (120) to be located next to the first vehicle side (115) or the second vehicle side (116).

In some embodiments, the exhaust collector (120) comprises flexible connections located thereon between the air injection ports (140) and the air injection tubes (150).

In some embodiments, a combined collector outlet port cross-sectional area (161) is at least two times greater than an exhaust inlet port cross-sectional area (131). In some embodiments, the combined collector outlet port cross-sectional area (161) being at least two times greater than an exhaust inlet port cross-sectional area (131) is critical to the operation of the present invention to reduce back pressure against the diesel engine (111).

In some embodiments, the exhaust inlet port (130) is located opposite the air injection ports (140) to optimize mixing of the stream of exhaust gas and the accelerated stream of ambient air from the ambient air injection ports (140). In some embodiments, the collector outlet ports (160) are located at a right angle to the exhaust inlet port (130) and the air injection ports (140).

In some embodiments, the air injection tubes (150) comprises a shape of a "U".

In some embodiments, a collector length (190) is at least three times a collector width (191).

In some embodiments, the divider (127) is constructed from a perforated material.

In some embodiments, the anterior chamber (125) is volumetrically at least three times larger than the posterior chamber (126).

In some embodiments, a semi-cylindrical hood (180) is linearly located in the anterior chamber (125) directly beneath the collector outlet ports (160) to add resonance time to the exhaust gas and air mixture in a turbulent zone in the anterior chamber (125).

In some embodiments, an exhaust gas pressure entering the exhaust inlet port (130) is greater than an air injection pressure entering the air injection ports (140).

In some embodiments, the system (100) comprises two air injection ports (140) and two air injection tubes (150).

In some embodiments, the system (100) comprises three collector outlet ports (160) and three collector outlet pipes (170).

As used herein, the term "about" refers to plus or minus 10% of the referenced number.

The disclosures of the following U.S. Patents are incorporated in their entirety by reference herein: U.S. Pat. No. 5,609,021; U.S. Pat. No. 4,640,256; U.S. Pat. No. 4,628,689; U.S. Pat. No. 4,209,981; U.S. Pat. No. 3,224,171; U.S. Pat. No. 2,737,260; and U.S. Pat. No. 1,867,325.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A diesel exhaust gas collection and treatment system (100) for collecting exhaust gas from a diesel engine powered vehicle, treating the exhaust gas with injected ambient air, then releasing the air and exhaust gas mixture to the atmosphere, wherein the system (100) comprises:

(a) a vehicle (110) powered by a diesel engine (111), wherein the diesel engine (111) comprises an exhaust manifold (112) disposed thereon, wherein a stream of exhaust gas from operation of the diesel engine (111) flows from the diesel engine (111) through the exhaust manifold (112); and (b) a generally tubular exhaust collector (120) having an anterior collector end (121), a posterior collector end (122), and a collector side wall (123), wherein an anterior chamber (125) is disposed therein adjacent to the anterior collector end (121) and a posterior chamber (126) is disposed therein adjacent to the posterior collector end (122), wherein the anterior chamber (125) is separated from the posterior chamber (126) via a non-solid planar divider (127), wherein the exhaust collector (120) comprises (i) an exhaust inlet port (130) centrally disposed on the anterior collector end (121), wherein the exhaust inlet port (130) is fluidly connected to the anterior chamber (125), wherein the exhaust inlet port (130) is fluidly connected to the exhaust manifold (112) via exhaust piping (113), (ii) a plurality of ambient air injection ports (140) disposed on the posterior collector end (122), wherein each air injection port (140) is fluidly connected to the posterior chamber (126), (iii) a plurality of ambient air injection tubes (150), wherein each air injection tube (150) is fluidly disposed on and connected to a corresponding air injection port (140), wherein each air injection tube (150) comprises an injection tube inlet (151) and an injection tube outlet (152), wherein the air injection tube inlet (151) and the air injection tube outlet (152) face a same direction, wherein the injection tube comprises a tube inlet diameter (153) at least two times larger than a tube outlet diameter (154) for acceleration of the ambient air passing through the air injection tube (150), (iv) a plurality of collector outlet ports (160) disposed on the exhaust collector side wall (123), wherein each collector outlet port (160) is fluidly connected to the anterior chamber (125), and (v) a plurality of collector outlet pipes (170), wherein each collector outlet pipe (170) is disposed on and fluidly connected to a corresponding collector outlet port (160), wherein each collector outlet pipe (170) comprises an open outlet pipe terminating end (171) facing a direction opposed the injection tube inlet (151), wherein the exhaust collector (120) is flexibly suspended underneath the vehicle (110), wherein the exhaust collector (120) is disposed adjacent to a first vehicle side (115) or a second vehicle side (116), wherein the exhaust collector (120) comprises flexible connections disposed thereon between the air injection ports (140) and the air injection tubes (150), wherein a combined collector outlet port cross-sectional area (161) is at least two times greater than an exhaust inlet port cross-sectional area (131), wherein the exhaust inlet port (130) is disposed opposite the air injection ports (140) to optimize mixing of the stream of exhaust gas and the accelerated stream of ambient air from the ambient air injection ports (140), wherein the collector outlet ports (160) are disposed at a right angle to the exhaust inlet port (130) and the air injection ports (140).

2. The system (100) of claim 1, wherein the air injection tubes (150) comprises a shape of a "U".

3. The system (100) of claim 1, wherein a collector length (190) is at least three times a collector width (191).

4. The system (100) of claim 1, wherein the divider (127) is constructed from a perforated material.

5. The system (100) of claim 1, wherein the anterior chamber (125) is volumetrically at least three times larger than the posterior chamber (126).

6. The system (100) of claim 1, wherein a semi-cylindrical hood (180) is linearly disposed in the anterior chamber (125) directly beneath the collector outlet ports (160).

7. The system (100) of claim 1, wherein an exhaust gas pressure entering the exhaust inlet port (130) is greater than an air injection pressure entering the air injection ports (140).

8. The system of claim 1, wherein the system (100) comprises two air injection ports (140) and two air injection tubes (150).

9. The system of claim 1, wherein the system (100) comprises three collector outlet ports (160) and three collector outlet pipes (170).

* * * * *